United States Patent [19]

DeCorso et al.

[11] 3,991,560

[45] Nov. 16, 1976

[54] FLEXIBLE INTERCONNECTION FOR COMBUSTORS

[75] Inventors: Serafino M. DeCorso; Shou S. Lin, both of Media, Pa.

[73] Assignee: Westinghouse Electric Corporation, Pittsburgh, Pa.

[22] Filed: Jan. 29, 1975

[21] Appl. No.: 545,233

[52] U.S. Cl. ..... 60/39.32; 60/39.82 P; 60/39.37

[51] Int. Cl.[2] ..... F02C 7/26

[58] Field of Search ..... 60/39.32, 39.82 R, 39.82 P, 60/39.37; 285/223, 224, 226, 166; 138/120

[56] References Cited

UNITED STATES PATENTS

| | | | |
|---|---|---|---|
| 1,001,842 | 8/1911 | Greenfield | 138/120 |
| 2,209,239 | 7/1940 | Sterzenbach | 138/120 |
| 3,500,639 | 3/1970 | Stamm | 60/39.32 |

*Primary Examiner*—Carlton R. Croyle
*Assistant Examiner*—Louis J. Casaregola
*Attorney, Agent, or Firm*—F. A. Winans

[57] ABSTRACT

An interconnection or crossover construction is provided for interconnecting the combustors of a combustion apparatus such as a gas turbine. The connection between adjacent combustors is made by means of a flexible tube which permits a substantial amount of misalignment between adjacent combustors, and the construction also provides for accommodating thermal expansion and contraction of the parts and for the admission of cooling air.

3 Claims, 4 Drawing Figures

FLEXIBLE INTERCONNECTION FOR COMBUSTORS

BACKGROUND OF THE INVENTION

The present invention relates to interconnection of the combustors in combustion apparatus such as gas turbines, and more particularly to an improved crossover tube for such connections.

Gas turbines include a combustion chamber disposed between a compressor section and a turbine section. The combustion chamber is usually of annular cross section with a plurality of combustors disposed in it. Combustion air is supplied by the compressor to the combustion chamber from which it flows into the combustors which are generally cylindrical members or baskets with a fuel supply and burner at one end and with suitable holes for the entrance of air. A plurality of combustors is provided and they are arranged side-by-side in an annular array extending around the combustion chamber. During operation, fuel is burned in the combustors to provide a supply of hot pressurized gas which is directed to the turbine section which drives the compressor and the output shaft.

The combustors are usually interconnected, each combustor having a tubular connection to the two adjacent combustors on opposite sides. Only one or two ignition devices are then needed to ignite all the combustors, the flame propagating through the interconnections from each combustor to the next. The interconnections between combustors usually comprise metal crossover tubes to provide communication between the combustors and it is necessary to provide for some misalignment between the corresponding connections of the adjacent combustors. Such misalignment may occur because of the necessary dimensional tolerances, and unavoidable thermal distortions, which make it difficult to insure exact alignment of the connectors on adjacent combustors. Heretofore, various expedients have been used to accommodate misalignment, such as flanged attachment means with spherical seats, and transversely slidable connections, but such expedients have not been satisfactory because of their limited ability to permit misalignment and because they are expensive and difficult to assemble. The interconnections should also allow thermal expansion and contraction of the parts and this further complicates the problem.

SUMMARY OF THE INVENTION

The present invention provides an interconnection between adjacent combustors in a combustion chamber which permits a greater degree of misalignment than has previously been possible and which is less expensive and easier to assemble than prior constructions.

More specifically, the invention provides an interconnection utilizing a flexible crossover tube of sufficient length and flexibility to permit a substantial amount of misalignment between the ends of the crossover tube. This flexible tube is connected to the adjacent combustors in a manner which permits relative axial movement to accommodate thermal expansion and contraction. For this purpose, one end of the crossover tube is rigidly attached to a combustor while the other end of the tube has a sliding telescopic fit with a fixed connector tube on the other combustor, so that free axial movement to accommodate thermal expansion is permitted. In accordance with a further feature of the invention, a plurality of openings is provided in each of the connections adjacent the combustors to permit entrance of cooling air to prevent overheating and possible damage.

BRIEF DESCRIPTION OF THE DRAWINGS

The invention will be more fully understood from the following detailed description, taken in connection with the accompanying drawing, in which.

DESCRIPTION OF THE PREFERRED EMBODIMENT

Figure 1:
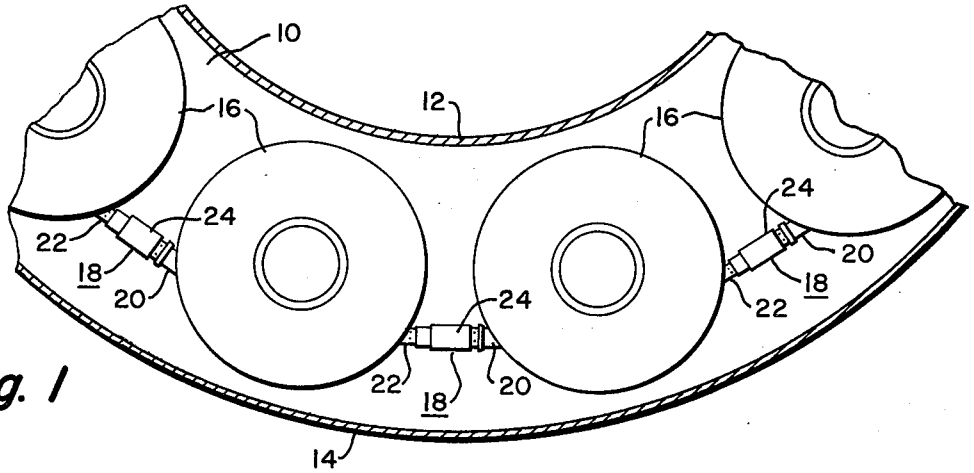
FIG. 1 is a parital, transverse sectional view of a combustion chamber with interconnected combustors.

An illustrative embodiment of the invention is shown in the drawing. FIG. 1 shows a portion of a combustion chamber 10 of a combustion apparatus such as a gas turbine. The chamber 10 is of generally annular cross-sectional configuration and is formed between inner and outer cylindrical or conical walls 12 and 14, respectively. The combustion chamber 10 is adapted to receive combustion air from a compressor (not shown) and supply the air to a plurality of combustors 16. Each of the combustors 16 is a generally cylindrical metal basket or flame tube adapted to burn a fuel, such as gas, with air which enters the combustor through suitable openings from the chamber 10. The detailed construction of the combustors 16 has not been illustrated since such combustors are well known in the art and they may be of any suitable construction.

A pluraltiy of combustors 16 is provided and they are disposed side-by-side in an annular array in the combustion chamber 10 as illustrated in FIG. 1. The combustors are connected by interconnections generally designated 18 which connect each combustor to the two adjacent combustors completely around the annular array. The purpose of the interconnections 18 is primarily to permit the use of only one or two ignition devices. As each combustor is ignited the interconnections will transmit the flame to the adjacent combustors to ignite them so that the flame is propagated from each combustor to the next around the array.

As previously discussed, such interconnections must allow for some degree of misalignment between the connections to adjacent combustors, and must also allow for thermal expansion and contraction since the combustors reach relatively high temperatures during operation. In accordance with the present invention this requirement is met by the use of a flexible crossover tube to make the interconnection.

Figure 2:
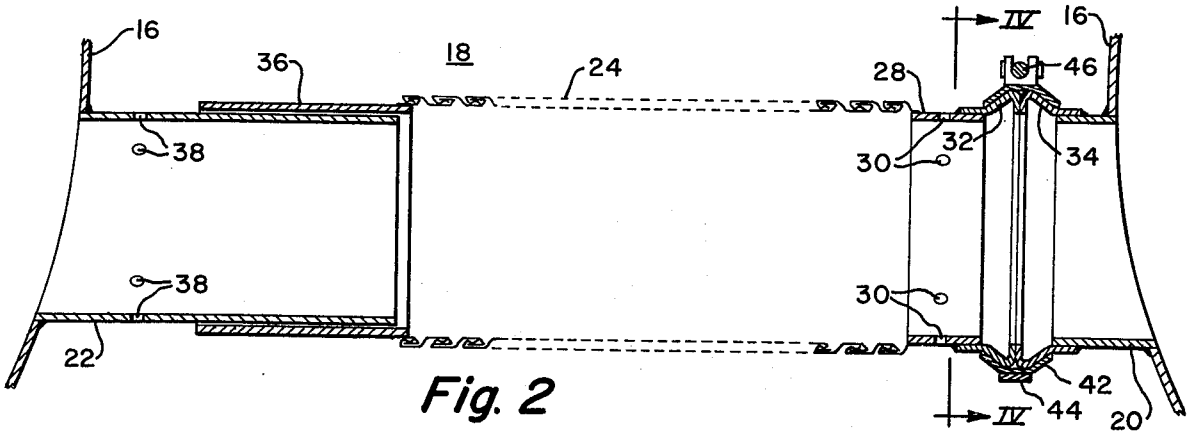
FIG. 2 is an enlarged sectional view showing the flexible interconnection of the present invention.
Figure 4:
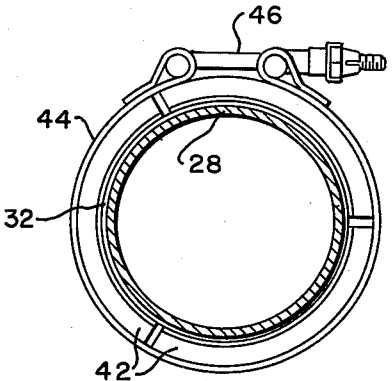
FIG. 4 is a transverse view substantially on the line IV—IV of FIG. 2.

As shown in FIGS. 1 and 2, each combustor has connecting tubes disposed on opposite sides thereof. Thus, each combustor 16 has a relatively short connecting tube 20 disposed on one side thereof and welded in place. A longer tube 22 is similarly provided on the opposite side of each combustor 16, the tubes 20 and 22 being inclined at a slight angle with respect to each other, as shown in FIG. 1, to conform to the circular disposition of the array of combustors 16. As can be seen in FIG. 1, the combustors are disposed so that the short tube 20 of each combustor is arranged coaxially with the corresponding longer tube 22 of the next adjacent combustor in position to be connected thereto. The corresponding tubes 20 and 22 of each pair of adjacent combustors are interconnected by a flexible crossover tube 24. The tube 24 is of suitable length to make the interconnection and is preferably a metal tube capable of withstanding the high temperatures to which it will be subjected and with sufficient flexibility to permit a considerable amount of misalignment between opposite ends of the tube. Any suitable construction may be used for this purpose, one suitable construction being shown in FIG. 3 which is an enlarged detail view of a small portion of the wall of the tube 24. As there shown, the tube may be made up of a plurality of interlocking metal tubular segments 26 which overlap one another to provide telescopic engagement between adjacent segments which are interconnected as shown to provide adequate mechanical strength and reasonable tightness and yet provide a substantial degree of flexibility. It will be understood, however, that any suitable type of flexible tubing may be utilized.

The ends of each of the tubes 24 are connected in any suitable manner to the connecting tubes 20 and 22 of the adjacent combustors 16. As shown in FIG. 2, one end of the tube 24 may be welded or otherwise attached to a short piece of tubing 28 which may, for example, be of stainless steel, or other suitable material, and which has a plurality of holes or openings 30 spaced circumferentially around it. A curved metallic flange 32 is welded or otherwise attached to the tube 28 and a corresponding flange 34 is welded to the outer end of the connector tube 20. The other end of each tube 24 is welded or otherwise attached to a somewhat longer piece of tubing 36, which may also be of stainless steel, and which has an internal diameter to fit snugly over the connector tube 22 of the combustor with a sliding telescopic fit which will permit relative axial movement of the tubes 22 and 36. The tube 22 preferably has a plurality of holes or openings 38 in it beyond the end of the tube 36.

In each complete assembled interconnection 18, the flanged ends 32 and 34 of the tubes 28 and 20, respectively, abut each other as shown in FIG. 2 and are clamped rigidly together by a clamp of any suitable type, which is shown as comprising segmental clamping members 42 which engage the flanges 32 and 34 and which are clamped in place by a strap member 44 and a clamping bolt 46. A rigid connection is thus made between one end of the tube 24 and the connector tube 20 of the combustor 16. It will be understood that although a particular type of clamp has been shown, any suitable type of clamp might be utilized, or the tubes 20 and 28 might be provided with straight radial flanges and bolted together, or a rigid connection may be made in any other desired manner. At the other end of the tube 24, the tube 36 engages the tube 22 of the adjacent combustor with a sliding telescopic engagement which permits axial movement to allow for thermal expansion and contraction.

It will be seen that the crossover tubes 24 are thus connected to interconnect each pair of adjacent combustors in a manner that meets the requirements previously discussed. Thus, the tubes 24 are sufficiently flexible to accommodate a substantial amount of misaligment between the corresponding connector tubes 20 and 22 of adjacent combustors, which may occur because of dimensional tolerances or because of unavoidable distortions in operation or in assembly. The tube 24 is rigidly attached at one end to the connector tube 20 but at the other end a sliding connection is provided which permits a considerable amount of relative axial movement to accommodate the relatively large thermal expansions and contractions which may occur because of the high temperatures reached in the combustors 16 during operation. A relatively simple structure is thus provided which is inexpensive and easy to assemble.

Figure 3:
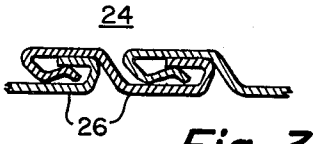
FIG. 3 is an enlarged detail view of a portion of a flexible crossover tube.

The openings 30 and 38 in the tubes 28 and 22, respectively, permit a controlled amount of leakage of air for the purpose of cooling the connecting tube and the members to which it is joined. The number and size of these holes are determined to admit the desired amount of air from the combustion chamber 10 to keep the temperatures within permissible limits, the preferred construtsion of the tube 24 itself, as shown in FIG. 3, being such that a certain amount of leakage can also occur through the tube wall. If desired, additional openings might be provided through the wall of the tube 24 to function as stabilizer holes to attenuate the crossfire intensity and to stabilize the system against occasional cross-firing during load operation.

It will now be apparent that an interconnection means has been provided for the combustors of a combustion apparatus which meets the requirements in a very effective manner by the use of a flexible crossover tube which accommodates substantial misalignment, and which is mounted in a manner to also allow thermal expansion and contraction and to provide the desired cooling of the structure. A flexible interconnector is thus provided which is less expensive and easier to assemble than prior constructions and which accommodates a greater number of misalignment as well as having the other advantages stated.

What is claimed is:

1. Combustion apparatus of a gas turbine engine, said comprising a plurality of combustors disposed side-by-side in an annular array, and crossover means providing a generally closed flow path connecting each combustor with the next adjacent combustor on either side for combustion propagation from one combustor to the next therethrough, wherein said crossover means comprises:

a pair of opposed generally axially aligned short tube members extending toward each other from adjacent combustors; and, a flexible metal tube connecting said opposed short tubes, said flexible tube comprising:

a series of adjacent tubular segments with each of said segments having a portion telescopically overlapping a portion of the next adjacent segment to provide limited fluid leakage for the entry of cooling air at each overlapping portion and also providing limited relative axial and angular movement between adjacent segments so that the resulting flexibility provided by said series of segments extending across said axial distance is sufficient to accommodate axial misalignment between said opposed short tube members along with variations in the spacial separation of said tube members due to expansion or contraction of said combustors under operating conditions.

2. Structure according to claim 1 wherein at least one end of said flexible tube is securely attached to one of said short tube members on said combustor.

3. Structure according to claim 2 wherein an opposite end of said flexible tube telescopically engages the other aligned short tube on said adjacent combustor.

* * * * *